US008801975B2

(12) United States Patent
Rapp et al.

(10) Patent No.: US 8,801,975 B2
(45) Date of Patent: Aug. 12, 2014

(54) VEGETABLE OIL DIELECTRIC FLUID COMPOSITION

(75) Inventors: Kevin J. Rapp, Oak Creek, WI (US); Charles Patrick McShane, Waukesha, WI (US); Gary A. Gauger, Franklin, WI (US); Arthur W. Lemm, Waukesha, WI (US)

(73) Assignee: Cooper Industries, LLC, Houston, TX (US)

( * ) Notice: Subject to any disclaimer, the term of this patent is extended or adjusted under 35 U.S.C. 154(b) by 314 days.

(21) Appl. No.: 11/804,306

(22) Filed: May 17, 2007

(65) Prior Publication Data

US 2008/0283803 A1 Nov. 20, 2008

(51) Int. Cl.
*H01B 3/20* (2006.01)

(52) U.S. Cl.
USPC ..... 252/579; 252/73; 252/570; 252/578; 336/94; 174/17 LF

(58) Field of Classification Search
USPC ..... 252/73, 75, 79, 365, 578, 579, 570; 174/17 LF; 336/94
See application file for complete search history.

(56) References Cited

U.S. PATENT DOCUMENTS

| | | | | |
|---|---|---|---|---|
| 5,169,669 | A | 12/1992 | Haynes et al. | |
| 5,451,334 | A | 9/1995 | Bongardt et al. | |
| 5,658,864 | A * | 8/1997 | Macpherson | 508/491 |
| 5,965,755 | A | 10/1999 | Sernyk et al. | |
| 6,169,190 | B1 | 1/2001 | Lanuza et al. | |
| 6,280,659 | B1 * | 8/2001 | Sundin | 252/578 |
| 6,303,849 | B1 * | 10/2001 | Potts et al. | 800/306 |
| 6,312,623 | B1 * | 11/2001 | Oommen et al. | 252/579 |
| 6,340,658 | B1 * | 1/2002 | Cannon et al. | 508/491 |
| 6,352,655 | B1 * | 3/2002 | McShane et al. | 252/579 |
| 6,398,986 | B1 * | 6/2002 | McShane et al. | 252/579 |
| 6,613,250 | B2 * | 9/2003 | McShane et al. | 252/579 |
| 7,048,875 | B2 * | 5/2006 | Oommen et al. | 252/579 |
| 2002/0049145 | A1 | 4/2002 | Cannon et al. | |
| 2006/0030499 | A1 | 2/2006 | Oommen et al. | |
| 2007/0215360 | A1 * | 9/2007 | Shuster et al. | 166/380 |

FOREIGN PATENT DOCUMENTS

| | | | |
|---|---|---|---|
| GB | 2 134 923 | | 8/1984 |
| JP | 2005135989 | A | 5/2005 |
| WO | 97/22977 | A1 | 6/1997 |
| WO | WO 03/093403 | A1 | 11/2003 |

OTHER PUBLICATIONS

European Search Report dated Jan. 17, 2008, for corresponding European Application No. 07108428.9, 5 pgs.

J.K.G. Kramer et al., "*Brassica campestris* var. Span: I. Fractionation of Rapeseed Oil by Molecular Distillation and Adsorption Chromatography," Lipids, vol. 10, Sep. 1975, pp. 505-510.

D.K. Salunkhe et al., "Rapeseed," *World Oilseeds Chemistry, Technology, and Utilization*, Chapter 3, pp. 59-96, 1992.

Notification of Transmittal of the International Search Report and the Written Opinion of the International Searching Authority, or the Declaration dated Oct. 14, 2008 for corresponding PCT Application No. PCT/US2008/006081, 18 pgs.

Reply to Written Opinion of the International Searching Authority, for corresponding PCT Application No. PCT/US2008/006081, 10 pgs.

International Preliminary Report on Patentability of corresponding PCT Application No. PCT/US2008/006081 dated Aug. 21, 2009 (14 pages).

European Search Report, from corresponding EP Application No. 11174287, mailed Oct. 25, 2011, 7 pages.

European Search Report, from corresponding EP Application No. 11174286, mailed Oct. 21, 2011, 7 pages.

Response to communication dated Oct. 13, 2011, for CA Application No. 2,683,310, 8 pages.

Communication pursuant to Article 94(3) EPC, from corresponding EP application No. 11174287.0-1358, dated Oct. 7, 2013, 4 pp.

Examination Report from corresponding Canadian application No. 2,786,816, dated Jul. 10, 2013, 2 pp.

* cited by examiner

*Primary Examiner* — Mark Kopec
*Assistant Examiner* — Haidung Nguyen
(74) *Attorney, Agent, or Firm* — Shumaker & Sieffert, P.A.

(57) ABSTRACT

An electrical device having therein a dielectric fluid composition, wherein the dielectric fluid composition includes at least one refined, bleached and deodorized vegetable oil and at least one antioxidant, wherein the dielectric fluid composition has a pour point of less than about −20° C. as measured according to either of ASTM D97 or ASTM D5950.

37 Claims, 2 Drawing Sheets

VEGETABLE OIL DIELECTRIC FLUID COMPOSITION

TECHNICAL FIELD

The present disclosure relates to dielectric fluids for use in electrical apparatus.

BACKGROUND

Dielectric (or insulating) fluid compositions used in electrical distribution and power equipment act as an electrical insulating medium, i.e., exhibit dielectric strength, and they transport generated heat away from the equipment, i.e., act as a cooling medium. When used in a transformer, for example, dielectric fluids transport heat from the windings and core of the transformer or connected circuits to cooling surfaces.

Liquid filled electrical apparatus used in certain climates may require a dielectric fluid composition that maintains its electrical and physical properties, particularly pourability, for extended periods at low temperatures. This pourability requirement has limited the range of applications for vegetable oil based dielectric fluid compositions, which typically have pour points above about −10° C.

SUMMARY

Since some electrical apparatus use large amounts of dielectric fluid, and the dielectric fluid may remain in the apparatus for extended periods of time, there is a possibility that, during the service life of the apparatus, the dielectric fluid may be introduced into the environment. To create a dielectric fluid with improved low temperature performance, a vegetable oil base fluid may be blended with petroleum based mineral oils or silicones, or formulated with significant amounts of non-biologically based synthetic additives. However, in many cases these additives are expensive, toxic and/or non-biodegradable, and accidental spillage or leakage from the electrical apparatus could damage the surrounding environment.

In one embodiment, this disclosure is directed to a dielectric fluid composition including at least one refined, bleached and deodorized (RBD) vegetable oil. The RBD vegetable oil has a sufficiently low pour point (less than about −20° C., preferably less than about −25° C., as measured according to either of ASTM D97 or ASTM D5950) to make the composition well suited for use in electrical apparatus, particularly in cold climates.

In one aspect, the present disclosure is directed to an electrical device having therein a dielectric fluid composition. The dielectric fluid composition includes at least one refined, bleached and deodorized vegetable oil and at least one antioxidant, wherein the dielectric fluid composition has a pour point of less than about −20° C. as measured according to either of ASTM D97 or ASTM D5950.

In another aspect, the present disclosure is directed to a composition consisting of at least one vegetable oil and at least one antioxidant, wherein the composition has a pour point of less than about −20° C. as measured according to either of ASTM D97 or ASTM D5950.

In another aspect, the present disclosure is directed to a composition consisting of at least one vegetable oil, at least one antioxidant, and at least one pour point depressant, wherein the composition has a pour point of less than about −30° C. as measured according to either of ASTM D97 or ASTM D5950.

In yet another aspect, the present disclosure is directed to a dielectric fluid composition including at least one rapeseed oil derived from non-GMO winter rapeseeds grown in a northern European climate; and a synthetic ester.

In yet another aspect, the present disclosure is directed to a dielectric fluid composition including at least one RBD vegetable oil, at least one synthetic ester, and at least one of one or more antioxidant compounds and one or more pour point depressants, wherein the composition has a pour point of less than about −30° C. as measured according to at least one of ASTM D97 and ASTM D5950 and a fire point greater than about 300° C., and wherein the dielectric fluid composition includes greater than about 70% by weight bio-based material as defined in USDA FB4P (2002 Farm Bill).

In yet anther aspect, the present disclosure is directed to a method of making a dielectric fluid, including providing at least one refined, bleached and deodorized rapeseed oil with a pour point of less than about −20° C. as measured by at least one of ASTM D97 and ASTM D5950; treating the rapeseed oil with clay; and filtering the rapeseed oil to produce a processed rapeseed oil.

In yet another aspect, the present disclosure is directed to a method of filling a transformer with a dielectric fluid, including removing the original dielectric fluid composition and replacing the original dielectric fluid with a new dielectric fluid composition including at least one RBD rapeseed oil and at least one of an antioxidant and a pour point depressant, wherein the composition has a pour point of less than about −20° C. as measured by either of ASTM D97 or ASTM D5950.

In yet another aspect, the present disclosure is directed to a method including providing an electrical device with a conductor insulated by a paper insulating material; and extending the service life of the paper insulating material in the electrical distribution device by employing in the device a dielectric fluid composition. The dielectric fluid composition includes at least one RBD rapeseed oil and at least one of an antioxidant and a pour point depressant, wherein the composition has a pour point of less than about −20° C. as measured by either of ASTM D97 or ASTM D5950.

The dielectric fluid compositions described herein have excellent electrical properties, even when formulated with a minimum amount of non-biologically based compounds. In some embodiments, the dielectric fluid composition qualifies as at least one of: (1) readily biodegradable as defined by USEPA OPPTS 835.3110; (2) ultimately biodegradable as defined by USEPA OPPTS 835.3100; and (3) biodegradable as measured by method OECD 301. The excellent low temperature performance of the vegetable oil dielectric fluid compositions, as well as their environmentally safe and bio-based nature, allows use of the fluids in apparatus and in climatic areas in which vegetable oil based fluids have not been previously employed. Since many components of the vegetable oil dielectric fluid compositions are derived from renewable, seed-based resources, the fluids may be produced easily and at a reasonable cost.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
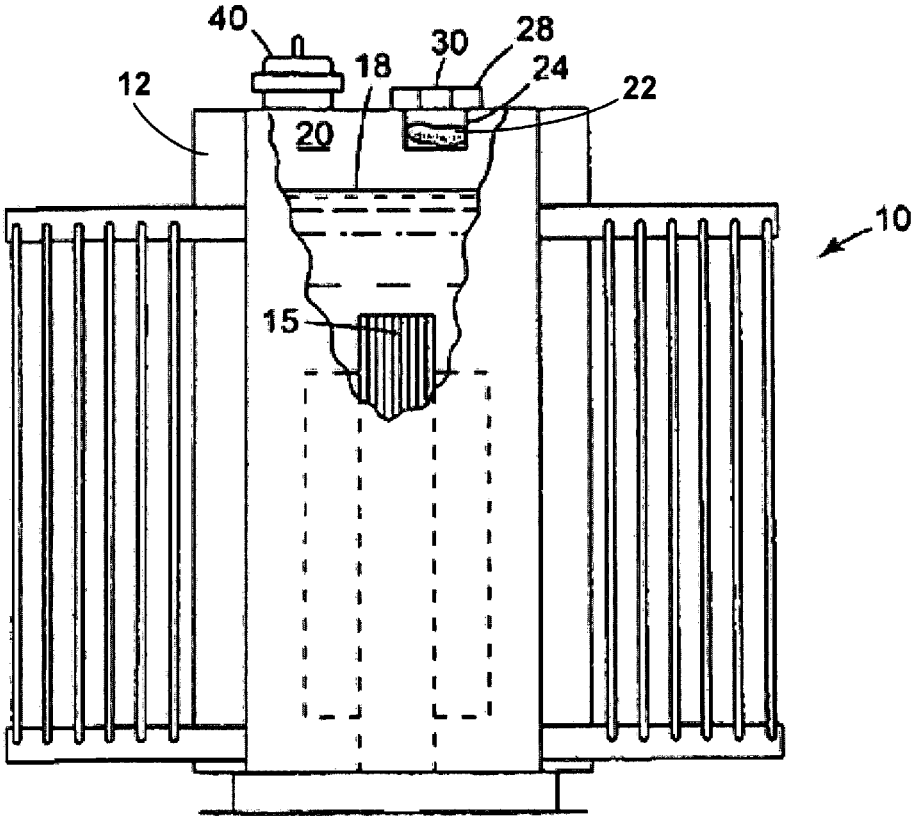
FIG. 1 is a cross-sectional view of a transformer including a vegetable oil dielectric fluid composition.

This disclosure is directed to dielectric fluid compositions including at least one refined, bleached and deodorized (RBD) vegetable oil. The RBD vegetable oil has a pour point of less than about −20° C., preferably less than about −25° C., as measured according to either of ASTM D97 or ASTM D5950. This low pour point makes the dielectric fluid compositions including the RBD vegetable oil well suited for use in electrical apparatus, particularly in cold climates.

In one embodiment, this disclosure is directed to a dielectric fluid composition that consists of at least one RBD vegetable oil and an antioxidant. The dielectric fluid composition has a pour point less than about −20° C., preferably less than about −25° C.

The term RBD vegetable oil as used herein refers to crude vegetable oils that have been further processed at a vegetable oil refinery. Typically, to make a RBD vegetable oil, crude vegetable oil is de-gummed after addition of water followed by alkali refining with a base such as NaOH, bleaching with clay and deodorization using vacuum steam stripping. The processing steps remove contaminants from the crude vegetable oils that would cause poor dielectric performance. Crude vegetable oils also contain more waxy components that would cause less desirable cold temperature performance.

The pour point of the dielectric fluid composition may be measured by either of two different methods, ASTM D97 or ASTM D5950 (pour point measurements per the test methods herein may vary as much as ±3° C.). ASTM D97, a manual technique, is an accepted standard test method for determination of pour point in the electrical equipment industry. However, automated equipment to measure pour point may in some cases provide improved speed and consistency per ASTM Method D5950. However, the D5950 method is not yet approved in the electrical industry, although the lubricating fluids industry has converted to and approved the D5950 automated method.

The vegetable oil is preferably obtained by processing naturally occurring (non-genetically modified, or non-GMO) seed stocks, but may also be obtained from genetically modified (GMO) seeds, or from blends of oils obtained from GMO and non-GMO seeds.

One suitable vegetable oil for the dielectric fluid composition may be obtained by processing GMO rapeseed, non-GMO rapeseed, and combinations thereof. Preferred oils are obtained from seeds grown in northern European regions. Oils obtained from non-GMO "winter" rapeseeds grown in northern European climates have particularly low pour points, and are preferred for use in electrical apparatus operated in cold climates. Suitable oils are available from Cargill, Inc., Minneapolis, Minn., under the trade designation Agri-Pure 60 Rapeseed Oil.

While not wishing to be bound by any theory, presently available evidence indicates that RBD oils obtained from northern European rapeseeds such as, for example, *Brassica napus, Brassica juncea* and *Brassica campestris* seeds, have a fatty acid distribution that results in a pour point of less than about −20° C., preferably less than about −25° C., as measured according to either of ASTM D97 or ASTM D5950. Other RBD rapeseed oils such as, for example, those available from North American seed stocks, exhibit a much higher pour point of about −10 to about −16° C. Compared to these North American oils, northern European rapeseed oils can provide a significant advantage in low temperature applications.

The northern European rapeseeds that are the source of the oils used in the dielectric fluid composition may be obtained from a single year's harvest, or oils from various cultivars may be blended to provide a vegetable oil dielectric fluid composition with the desired electrical, chemical and physical properties.

In addition to an exceptionally low pour point, dielectric fluid compositions including the preferred RBD oils derived from northern European rapeseeds oils have excellent electrical properties after appropriate processing.

The dielectric fluid compositions preferably have a dielectric strength of at least about 55 kv, preferably greater than about 60 kV. The dielectric strength may be measured per ASTM method D1816 using a 0.08 inch (2 mm) gap between VDE electrodes.

The dielectric fluid composition also preferably has a fire point greater than 300° C., as well as a flash point greater than about 275° C. Both fire point and flash point may be measured by ASTM D92.

The dielectric fluid composition also preferably has a dissipation factor (DF) at 25° C. of less than about 0.1%, and a dissipation factor at 100° C. of less than about 4%. The dissipation factors may be measured using ASTM D924.

Other electrical, chemical and physical properties are set forth in Table 4 below.

To ensure that the dielectric fluid composition remains flowable at relatively low temperatures, the vegetable oil used in the composition should preferably have a viscosity between 2 and 15 cSt at 100° C. and less than 110 cSt at 40° C. Preferably, the fluids used in the dielectric fluid composition have a viscosity between about 20 and about 50 cSt at 40° C.

A common method for measuring the kinematic viscosity at 40/100° C. is ASTM D445, however, at cold temperatures of −10° C. and −20° C. and colder, a different technique may be used. The yield stress and viscosity were measured using a Cannon mini-rotary viscometer (MRV) per ASTM D3829. The MRV operated as a concentric cylinder viscometer in which the yield stress is determined by observing the movement of the cylinder under different applied stress. For example, a 5' gram weight may be used to apply the yield stress and the viscosity may be determined by measuring the time to complete three revolutions. The time is multiplied by a constant, which depends on the cell used for the measurement, and the applied stress, to determine the dynamic viscosity in centipoise (cP). The dynamic viscosity in cP is converted to kinematic viscosity in centistokes (cSt) by dividing the dynamic viscosity by the density of the fluid at the specific temperature of measurement.

For example, the density may be determined using a 250 ml volumetric flask with a 15 ml graduated cylinder for a neck. The internal volume was calibrated with water at a known temperature and mass prior to measuring the fluid. The densities of the fluids at temperature were calculated using the weight of the fluid with the measured volume.

The vegetable oil dielectric fluid composition further includes one or more antioxidant compounds. Useful antioxidant compounds include, for example, BHA (butylated hydroxyanisole), BHT (butylated hydroxytoluene), TBHQ (tertiary butylhydroquinone), THBP (tetrahydrobutrophenone), ascorbyl palmitate (rosemary oil), propyl gallate, and alpha-, beta- or delta-tocopherol (vitamin E).

The antioxidant compounds may be present in the dielectric fluid composition at less than about 1 wt %, preferably less than about 0.5 wt %, based on the total weight of the composition.

In addition to the preferred rapeseed oils derived from northern European rapeseeds, any of the dielectric fluid compositions described herein may optionally include other vegetable oils as extenders or to modify its properties, including adjusting the pour point. Any commercially available seed oil may be used, and suitable additional vegetable oils include, for example, soybean, sunflower, crambe, corn, olive, cottonseed, safflower, vernonia, lesquerella and combinations thereof. Of these additional oils, soybean oil and sunflower oil are preferred.

The additional vegetable oils may be present or used in any amount, as long as their presence does not substantially degrade the physical, chemical and electrical properties of the composition.

In another embodiment, the vegetable oil dielectric fluid composition consists of at least one vegetable oil as described above, at least one antioxidant as described above, and at least one pour point depressant. A wide variety of compounds may be used as pour point depressants, and preferred pour point depressants include polyvinyl acetate oligomers and polymers and/or acrylic oligomers and polymers. Suitable pour point depressant compounds include (meth)acrylates such as those available from Rohmax, Philadelphia, Pa., under the trade designation Viscoplex. Alkyl methacrylates with a molecular weight of about 200,000, such as Viscoplex 10-310, have been found to be particularly suitable.

The pour point depressant may be used alone or may optionally be further diluted with a vegetable oil. Suitable vegetable oil diluted pour point depressant compounds include, for example, the vegetable oil diluted alkyl methacrylates available from Functional Products, Macedonia, Ohio, under the trade designation PD-551.

The pour point depressant is present in the vegetable oil dielectric fluid composition up to about 4 wt %, preferably about 0.2 wt % to about 2 wt %, and more preferably from about 0.4 wt % to 2 wt %.

Vegetable oil dielectric fluid compositions include an antioxidant and a pour point depressant typically have a pour point of less than about −30° C., preferably less than about −33° C., as measured by at least one of ASTM D97 and ASTM D5950. Including these additives, the vegetable oil dielectric fluid composition typically has a fire point greater than about 300° C., preferably greater than about 350° C., and a flash point of greater than about 275° C., preferably greater than about 325° C. Other properties of a typical vegetable oil dielectric fluid composition with additives are shown in Table 5 below.

Any of the dielectric fluid compositions described herein may optionally include a small amount of one or more additives to inhibit the growth of microorganisms. Any antimicrobial substance that is compatible with the dielectric fluid may be blended into the fluid. In some cases, compounds that are useful as antioxidants also may be used as antimicrobials. It is known, for example, that phenolic antioxidants such as BHA also exhibit some activity against bacteria, molds, viruses and protozoa, particularly when used with other antimicrobial substances such as potassium sorbate, sorbic acid or monoglycerides. Vitamin E, ascorbyl palmitate and other known compounds also are suitable for use as antimicrobial additives.

Any of the vegetable oil dielectric fluid compositions described herein may further optionally include a colorant such as a dye or pigment. Any known dye or pigment can be used for this purpose, and many are available commercially as food additives. The most useful dyes and pigments are those that are oil soluble. The colorant is present in the composition in minor amounts, typically less than about 1 ppm.

In appropriate circumstances, any of the vegetable oil dielectric fluid compositions described herein may optionally include a minor amount of one or more petroleum derived oils, such as, for example, mineral oils and/or polyalphaolefins. Mineral oils from naphthenic and paraffinic sources are typically refined and processed in to transformer fluids that meet the electrical industry standards per ASTM D3687. Suitable mineral oil-based dielectric fluids include, for example, those available from Petro-Canada under the trade designation Luminol TR, those available from Calumet Lubricating Co. under the trade designation Caltran 60-15, and those available from Ergon Refining Inc. under the trade designation Hivolt II. Suitable polyalphaolefins have a viscosity from about 2 cSt to about 14 cSt at 100° C., and are available from Chevron under the trade designation Synfluid PAO, Amoco under the trade designation Durasyn and Ethyl Corp. under the trade designation Ethylflo. Particularly preferred polyalphaolfins have a viscosity from about 4 cSt to about 8 cSt, and originate from dimers, trimers and tetramers of chains of 10 carbons. The most preferred viscosity range for the polyalphaolefins is from about 6 cSt to about 8 cSt.

The petroleum derived oils and polyalphaolefins may be incorporated into the composition at less than about 10% by weight, preferably less than about than 5 percent by weight.

In another embodiment, the present disclosure is directed to a vegetable oil dielectric fluid composition including at least one vegetable oil as described above, and a synthetic ester compound. In addition to the at least one vegetable oil and synthetic ester, the vegetable oil dielectric fluid composition preferable further includes an antioxidant as described above and a pour point depressant as described herein.

The synthetic ester may be blended with the vegetable oil and other optional components in an amount sufficient to modify the properties of the dielectric fluid composition, particularly to further lower pour point for a particular cold temperature application. The term "synthetic ester" as used herein refers to esters produced by a reaction between: (1) a bio-based or petroleum-derived polyol; and, (2) a linear or branched organic acid that may be bio-based or petroleum-derived. The term polyol as used herein refers to alcohols with two or more hydroxyl groups.

While the synthetic esters may be derived from biologically based compounds, petroleum by-products, or combinations thereof, biologically based esters derived from renewable compounds produced by animals and plants are preferred.

As used herein, the term bio-based refers to compounds derived from substances produced by either animals and/or naturally occurring or cultivated plants. The plant and animal sources for the bio-based compounds may be GMO, non-GMO and combinations thereof, and non-GMO sources are preferred. The term "bio-based" has the meaning set forth in the USDA FB4P (2002 Farm Bill), e.g. 70 Fed. Reg. 1792 (Jan. 11, 2005) and 71 Fed. Reg. 59862 (Oct. 11, 2006) (to be codified at 7 C.F.R. pt. 2902).

Suitable examples of bio-based synthetic esters include those produced by reacting a polyol and an organic acid with carbon chain lengths of C8-C10 derived from a vegetable oil such as, for example, coconut oil. Suitable synthetic esters are available from Cargill (Brazil) under the trade designation Innovatti, as well as from Hatco Chemical Co., Kearney, N.J. Among these synthetic esters, synthetic pentaerithritol esters with C7-C9 groups available under the trade designation Envirotemp 200 (E200) from Cooper Power Systems and Hatco 5005 from Hatco Chemical Co., as well as trimethylolpropane (TMP) esters with C8-C10 groups available under the trade designation EXP 1906 from Innovatti and Hatco 2938 from Hatco Chemical Co., are particularly well suited for use in the dielectric fluid compositions. Other polyols suitable for reacting with organic acids to make synthetic esters include, for example, neopentyl glycol, dipentaerythritol, and 2-ethylhexyl, n-octyl, isooctyl, isononyl, isodecyl and tridecyl alcohols.

The synthetic esters may be used in the vegetable oil dielectric fluid composition at up to about 70% by weight, preferably about 30% by weight to about 70% by weight, and even more preferably about 25% by weight to 70% by weight. Generally, larger amounts of the synthetic ester result in a dielectric fluid composition with a lower pour point. For example, some vegetable oil dielectric fluid compositions including up to about 30 wt % synthetic ester have a pour point of less than about −38° C., while some compositions including up to about 70 wt % synthetic ester have a pour point of less than about −50° C., according to at least one of ASTM D97 and ASTM D5950.

While incorporation of non-bio based synthetic materials may improve certain properties of the vegetable oil dielectric fluid compositions described above, addition of these compounds also increases costs and may reduce the "environmentally friendly" nature of the composition. To ensure that a spill or leak of the vegetable oil dielectric fluid composition will not have significant environmental impact, the composition should preferably be biodegradable, nontoxic and formulated with a minimum of non-bio based material. The vegetable oil dielectric fluid composition should preferably include at least 70% bio-based material and more preferably at least about 72.5% bio-based material.

For example, bio-based content can be determined by using ASTM Method D 6866, which is based on the amount of bio-based carbon in the material as % of the mass of the total organic carbon in the product.

The vegetable oil dielectric fluid compositions described above should also preferably be formulated to include a minimum amount of non-biodegradable material. The amount of synthetic and/or non-biodegradable additives in the vegetable oil dielectric fluid composition should preferably be limited such that the composition qualifies as at least one of: (1) readily biodegradable as defined by USEPA OPPTS 835.3110; (2) ultimately biodegradable as defined by USEPA OPPTS 835.3100; and (3) biodegradable as measured by method OECD 301.

Readily biodegradable as defined by USEPA OPPTS 835.3110 is an arbitrary classification of chemicals which have passed certain specified screening tests for ultimate biodegradability. These tests are so stringent that it is assumed that such compounds will rapidly and completely biodegrade in aquatic environments under aerobic conditions.

Ultimate biodegradability as defined by USEPA OPPTS 835.3100 is the breakdown of an organic compound to $CO_2$, water, the oxides or mineral salts of other elements, and/or to products associated with normal metabolic processes of microorganisms.

The vegetable oil dielectric fluid compositions described above should preferably be formulated to be essentially free of GMO material, which means that the composition includes no more than about 5% by weight GMO material. Even more preferably, the composition should be substantially free of GMO material (no more than about 1 wt % GMO), and most preferably completely free of GMO material, which means that no GMO material is present in the composition except for impurities. In the present application, substantially does not exclude completely, e.g. a composition that is substantially free from GMO material may be completely free from GMO material. Where necessary, the word substantially may be omitted from the definition of the invention.

The vegetable oil dielectric fluid compositions described above may be made by taking commercially available refined, bleached and deodorized (RBD) vegetable oils and treating the oils to remove impurities and improve electrical properties. The RBD oils are typically treated by removing moisture and stirring with an absorber, such as an activated clay, to remove impurities, which can be detrimental to the electrical properties of the oils. In addition to or instead of the clay treatment step, the RBD oils may be heated and/or filtered to remove particles, microorganisms and the like.

Preferably, the RBD oils are treated by adding about 10 wt % heated clay (170° C.) to the heated oil while stirring. The oil is then filtered to remove the clay particles containing the absorbed contaminants followed by vacuum processing to less than about 10 torr.

Typically, following these or similar treatment steps, preferred processed oils contain a maximum of about 200 ppm water, more preferably a maximum of about 100 ppm water.

Following the impurity removal steps, the processed oils may be used alone as dielectric fluids in electrical apparatus. However, prior to use the oils are typically blended with the additives described above, e.g. antioxidants, pour point depressants, colorants and the like. The processed oils may be further blended with additional vegetable oils, synthetic esters, synthetic or petroleum derived oils and the like to tailor their properties for a particular application.

In another embodiment, the present disclosure is directed at electrical apparatus having therein a dielectric fluid composition including at least one RBD vegetable oil as described above and an antioxidant. The dielectric fluid composition has a pour point of less than about −20° C., preferably less than about −25° C., as measured according to either of ASTM D97 or ASTM D5950. In addition to the antioxidant, the dielectric fluid composition in the electrical apparatus may further include any of the additives described above, including, for example, pour point depressants, additional vegetable oils, synthetic esters, mineral oils, polyalphaolefins, and the like.

The vegetable oil dielectric fluid composition may be incorporated into any electrical equipment or apparatus including, but not limited to, transformers, switchgear, regulators and reclosers.

For example, referring to FIG. 1, a transformer 10 includes a tank body 12 enclosing a transformer core coil assembly and windings 15. The core coil assembly and windings 15 are at least partially immersed in a dielectric fluid 18. The space between a surface of the fluid 18 and the tank body 12, referred to as the headspace 20, may optionally include an oxygen permeable container 24 housing an oxidation reducing composition 22 such as those described in US 2005/0040375. For example, a pre-packaged oxygen scavenging compound, such as is available commercially under the Ageless and Freshmax trade names, may be encased in a pouch constructed of a oxygen permeable polymer film, a polyester felt or a cellulose pressboard. The tank body 12 may also include optional features such as a threaded plug 28 with a view port 30, and a pressure release device 40.

The dielectric fluid compositions preferably are introduced into the electrical apparatus in a manner that minimizes the exposure of the fluid to atmospheric oxygen, moisture, and other contaminants that could adversely affect their performance. A preferred process includes drying of the tank contents, evacuation and substitution of air with dry nitrogen gas, filling under partial vacuum, and immediate sealing of the tank. If the electrical device requires a headspace between the dielectric fluid and tank cover, after filling and sealing of the tank, the gas in the headspace may be evacuated and substituted with an inert gas, such as dry nitrogen.

Electrical transformers and switchgear typically are constructed by immersing the core and windings and other electrical equipment in a dielectric fluid and enclosing the immersed components in a sealed housing or tank. The windings in larger equipment frequently are also wrapped with a cellulose or paper material. The vegetable oil dielectric fluid compositions described herein also may be used to protect and extend the useful service life of the cellulose chains of the paper insulating material. While not wishing to be bound by any theory, presently available evidence indicates that the vegetable oil dielectric fluids absorb water from the paper, which prevents the paper from hydrolytic degradation, and provides long-chain fatty acids that transesterify the cellulose and further reduce paper breakdown, particularly at higher equipment operating temperatures.

The vegetable oil dielectric fluids compositions can also be used to retrofill existing electrical equipment that incorporate other, less desirable dielectric fluids. Retrofilling existing equipment can be accomplished using any suitable method known in the art, though because of the increased sensitivity of vegetable oil fluids to moisture, the components of the electrical equipment may optionally be dried prior to the introduction of the vegetable oil based dielectric fluid. This may be particularly useful if the equipment includes cellulose or paper wrapping, which can absorb moisture over time. Because of the relatively high solubility of water in vegetable oils, a vegetable oil fluid can itself be used to dry out existing electrical equipment.

EXAMPLES

Example 1

Three different samples of RBD European Rapeseed oil that represent at least three different crop years were obtained and tested. The oils were obtained from a refinery in Antwerp, Belgium.

The results are shown in Table 1 below.

TABLE 1

| Sample | Crop Year | Pour Point (° C.) (ASTM D97) |
|---|---|---|
| 1 | 2004 | −26 |
| 2 | 2005 | −25 |
| 3 | 2006 | −26 |

Example 2

The pour points of the following fluids were measured according to ASTM D 97 and ASTM D5950, and the results are shown in Table 2.

TABLE 2

| Sample | Pour Point (° C.) ASTM D97 | Pour Point (° C.) ASTM D5950 |
|---|---|---|
| 100% Euro-Rapeseed/"As received" | −21 | −20 |
| 100% Euro-Rapeseed/ Clay treated - No additives | −21 | −24 |

Example 3

Samples of European soybean oil and European rapeseed oil were obtained for analysis. The rapeseed oil was Cargill Agri-Pure 60 from Antwerp, Belgium. As received, the RBD soybean oil had a pour point of about −10 to about −16° C. according to ASTM D5950, while the RBD rapeseed oil had a pour point of −26° C.

The properties of the oils are shown in Table 3 below.

TABLE 3

| | Euro-Rapeseed | Soybean Oil |
|---|---|---|
| Moisture | 37 ppm | 66 ppm* |
| Dielectric D1816 | 62 kV | 46 kV* |
| DF @ 25° C. | 0.04% | 0.21% |
| DF @ 100° C. | 1.91% | 5.67% |
| Acid No. | 0.069 mg KOH/g | 0.014 mg KOH/g |
| IFT | 28.6 dynes/cm | 27.1 dynes/cm |
| Flash Point | 334° C. | 334° C. |
| Fire Point | 358° C. | 360° C. |
| Pour Point | −26° C. | −10° C. |

*After 24 hours vacuum treatment, moisture = 1 ppm, D1816 = 54 kV

The RBD oils were then treated with clay and filtered, and the properties of the resulting processed oils are shown in Table 4 below.

TABLE 4

| | Euro-Rapeseed | Soybean Oil |
|---|---|---|
| Moisture | 3 ppm | 1 ppm |
| Dielectric D1816 | 71 kV | 61 kV |
| DF @ 25° C. | 0.02% | 0.01% |
| DF @ 100° C. | 0.39% | 0.38% |
| Acid No. | 0.029 mg KOH/g | 0.005 mg KOH/g |
| IFT | 32.0 dynes/cm | 30.0 dynes/cm |
| Flash Point | 334° C. | 336° C. |
| Fire Point | 358° C. | 362° C. |
| Pour Point | −21° C. | −10° C. |
| Viscosity @ 40° C. | 34.90 cSt | 31.40 cSt |
| Viscosity @ 100° C. | 8.04 cSt | 7.77 cSt |

The processed oils were then blended with additives to enhance their performance as electrical insulating fluids. The processed oils were blended with 0.40% by weight of BHT antioxidant, and 1.0 wt % of a pour point depressant, Viscoplex 10-310, available from Rohmax, Philadelphia, Pa.

The properties of the resulting blends are shown in Table 5 below.

TABLE 5

| | Euro-Rapeseed | Soybean Oil |
|---|---|---|
| Moisture | 13 ppm | 5 ppm |
| Dielectric D1816 | 73 kV | 66 kV |
| DF @ 25° C. | 0.02% | 0.03% |
| DF @ 100° C. | 1.53% | 1.75% |
| Acid No. | 0.047 mg KOH/g | 0.028 mg KOH/g |
| IFT | 32.2 dynes/cm | 31.6 dynes/cm |
| Flash Point | 332° C. | 330° C. |
| Fire Point | 358° C. | 360° C. |
| Pour Point (D5950) | −33° C. | −26° C. |
| Pour Point (D97) | −31° C. | −24° C. |
| Viscosity @ 40° C. | 36.31 cSt | 34.53 cSt |
| Viscosity @ 100° C. | 8.79 cSt | 8.35 cSt |
| Volume Resistivity | $74 \times 10^{12}$ | $51 \times 10^{12}$ |

Example 4

The Euro Rapeseed Oil from Example 2 was blended with various synthetic esters as shown in Table 6 below.

In Table 6, Soybean Oil refers to a soybean oil derived dielectric fluid available from Cooper Power Systems, Waukesha, Wis., under the trade designation Envirotemp FR3 Fluid.

TABLE 6

| Base Fluid | Synthetic Ester E200 | Synthetic Ester EXP 1906 | Pour Point (° C.) (ASTM D5950) | Pour Point (° C.) (ASTM D97) | Beneficial Aspects: Fire Point >300° C. | Beneficial Aspects: >70% Bio-based & Renewable |
|---|---|---|---|---|---|---|
| Example C1 30% Soybean Oil | 0 | 70% | −48 | | Yes (304° C.) | Yes |
| Example C2 70% Soybean Oil | 0 | 30% | −33 | −34 | Yes (323° C.) | Yes |
| Example 3-1 30% Euro-Rapeseed | 0 | 70% | −50 | | Yes (303° C.) | Yes |
| Example 3-2 70% Euro-Rapeseed | 0 | 30% | −39 | −38 | Yes (321° C.) | Yes |
| Example 3-3 30% Euro-Rapeseed | 70% | 0 | −51 | | Yes | No |
| Example 3-4 70% Euro-Rapeseed | 30% | 0 | −38 | | Yes | No |
| Example 3-5 72.5% Euro-Rapeseed | 0 | 27.5% | −39 | −40 | Yes (327° C.) | Yes |

All blends in Table 6 contain up to 1.0% by wt pour point depressant (Viscoplex 10-310, available from Rohmax), and up to 0.4% by wt antioxidant in vegetable oil.
C1 and C2 represent comparative examples.
E200 = Synthetic pentaerithritol ester with C7-C9 groups available from Hatco Chemical Co. under the trade designation Hatco 5005
EXP 1906 = Synthetic ester with C8-C10 groups available from Hatco Chemical Co. under the trade designation Hatco 2938.

Example C2 compared to examples 3-2 and 3-4 show the improved cold temperature performance of the Euro-Rapeseed fluid compared to a soybean oil based fluid.

Example 5

The 100% Euro-Rapeseed oil from example 2 was blended with additives and tested to determine the viscosity over extended periods of time at low temperature. Likewise, the test was also performed on a soybean oil derived dielectric fluid available from Cooper Power Systems, Waukesha, Wis., under the trade designation Envirotemp FR3 Fluid. The results are shown in FIG. 2.

Figure 2:
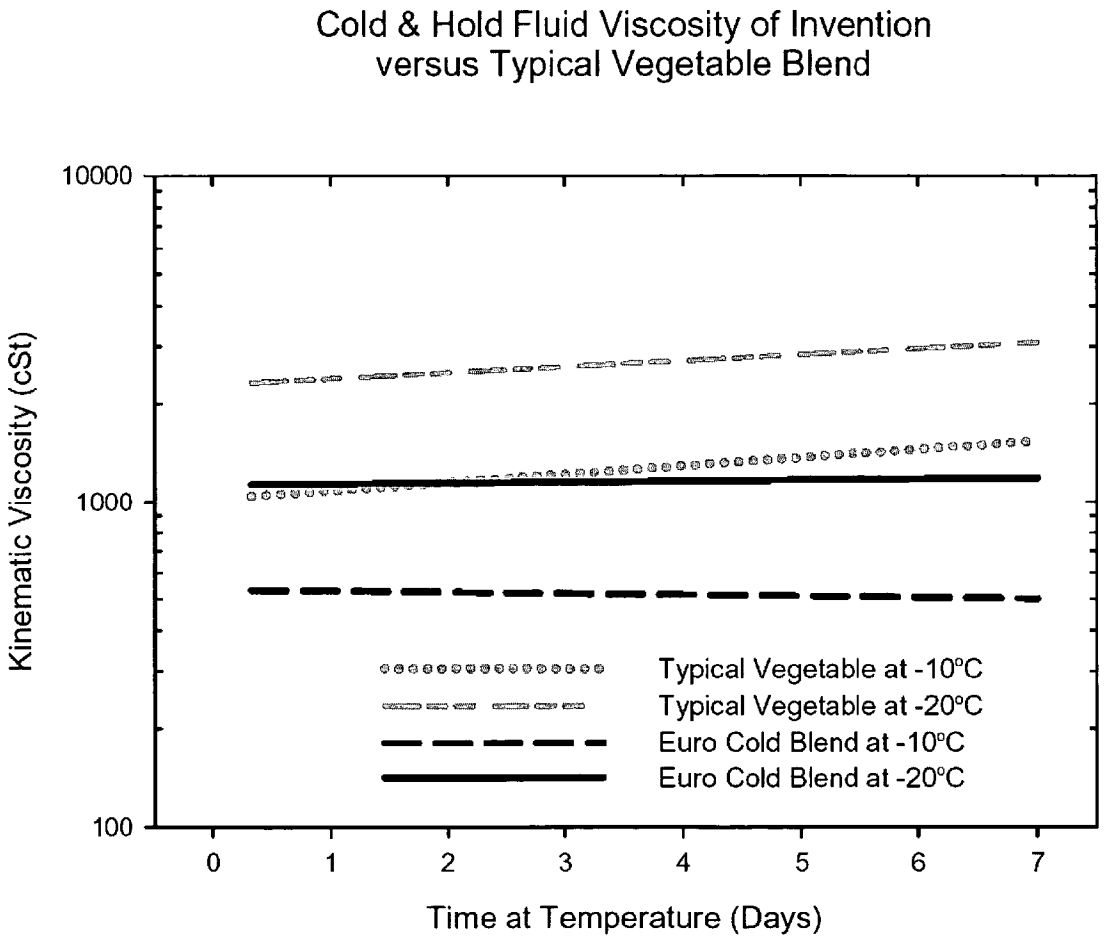
FIG. 2 is a plot showing the viscosity of dielectric fluids over time at temperatures of −10° C. and −20° C.

The results of FIG. 2 show that, when introduced into electrical power equipment, the substantially bio-based and biodegradable formulations of the presently described dielectric fluid composition flow and maintain a relatively constant viscosity for an extended period of time compared to a conventional vegetable oil.

Various embodiments of the invention have been described. These and other embodiments are within the scope of the following claims.

The invention claimed is:

1. An electrical device having therein a dielectric fluid composition, wherein the dielectric fluid composition comprises at least one refined, bleached and deodorized Northern European winter rapeseed oil having a fatty acid distribution with an oleic acid content of about 57% and at least one antioxidant, wherein the dielectric fluid composition has a pour point of less than about −20° C. as measured according to either of ASTM D97 or ASTM D5950, wherein the dielectric fluid composition is essentially free of GMO material, and wherein the electrical device is selected from a transformer, a switchgear, a regulator and a recloser.

2. The electrical device of claim 1, wherein the composition has a pour point of less than about −25° C.

3. The electrical device of claim 1, wherein the dielectric fluid composition further comprises at least one pour point depressant.

4. The electrical device of claim 1, wherein the dielectric fluid composition further comprises at least a second vegetable oil.

5. The electrical device of claim 4, wherein the second vegetable oil is selected from soybean, sunflower, crambe, corn, olive, cottonseed, safflower, vernonia, lesquerella and combinations thereof.

6. The electrical device of claim 1, wherein the dielectric fluid composition further comprises about 30% by weight to about 70% by weight of at least one synthetic ester.

7. The electrical device of claim 1, wherein the dielectric fluid composition further comprises a colorant.

8. The electrical device of claim 1, wherein the dielectric fluid composition is readily biodegradable as defined by USEPA OPPTS 835.3110.

9. The electrical device of claim 1, wherein the dielectric fluid composition is ultimately biodegradable as defined by USEPA OPPTS 835.3100.

10. The electrical device of claim 1, wherein the dielectric fluid composition is biodegradable as measured by method OECD 301.

11. The electrical device of claim 1, wherein the electrical device is a transformer.

12. An electrical device with a dielectric fluid composition therein, wherein the dielectric fluid composition comprises a Northern European winter rapeseed oil having a fatty acid distribution with an oleic acid content of about 57%;

at least one of a pour point depressant and an antioxidant; and

30% by weight to 70% by weight of a synthetic ester, wherein the composition is essentially free of GMO material.

13. The electrical device of claim 12, wherein the rapeseed oil, when refined, bleached and deodorized, has a pour point of less than about −20 C as measured according to either of ASTM D97 or ASTM D5950.

14. The electrical device of claim 12, wherein the dielectric fluid has a pour point of less than about −25° C. as measured according to either of ASTM D97 or ASTM D5950.

15. The electrical device of claim 12, wherein the synthetic ester is a bio-based material as defined in USDA FB4P (2002 Farm Bill).

16. The electrical device of claim 12, further comprising at least one additional vegetable oil selected from at least one of soybean, sunflower, crambe, corn, olive, cottonseed, safflower, vernonia, lesquerella and combinations thereof.

17. The electrical device of claim 16, wherein the additional vegetable oil is at least one of soybean, sunflower and combinations thereof.

18. The electrical device of claim 16, wherein at least one additional oil is sunflower oil.

19. The electrical device of claim 12, further comprising a colorant.

20. The electrical device of claim 12, wherein the dielectric fluid composition has a pour point of less than about −30° C. as measured according to at least one of ASTM D97 and ASTM D5950, a fire point greater than about 300° C., and wherein the dielectric fluid composition comprises greater than about 70% by weight bio-based material as defined in USDA FB4P (2002 Farm Bill).

21. The electrical device of claim 20, wherein the composition has a pour point of less than −40° C.

22. The electrical device of claim 20, wherein the synthetic ester is a bio based material.

23. The electrical device of claim 16, wherein at least one vegetable oil has a viscosity between 2 and 15 cSt at 100° C. and less than 110 cSt at 40° C.

24. The electrical device of claim 20, wherein the one or more antioxidant compounds comprise butylated hydroxyanisole (BHA), butylated hydroxytoluene (BHT), tertiary butylhydroxyquinone (TBHQ), tetrahydroxybutrophenone (THBP), ascorbyl palmitate, propyl gallate and alpha-, beta- or delta-tocopherol.

25. The electrical device of claim 20, wherein the composition is readily biodegradable as defined by USEPA OPPTS 835.3110.

26. The electrical device of claim 20, wherein the dielectric fluid composition is ultimately biodegradable as defined by USEPA OPPTS 835.3100.

27. The electrical device of claim 20, wherein the dielectric fluid composition is biodegradable as measured by method OECD 301.

28. The electrical device of claim 20, wherein the dielectric fluid composition is substantially free of genetically modified material.

29. The electrical device of claim 20, wherein the dielectric fluid composition has one or more of the following properties:

(a) an electrical breakdown strength D1816 greater than about 55 kV;

(b) a dissipation factor at room temperature less than about 0.1%;

(c) a dissipation factor of less than about 4% at 100° C.; and (d) a maximum moisture content of 100 ppm.

30. A method of filling a transformer with a dielectric fluid, comprising:

removing an original dielectric fluid composition from the transformer; and replacing the original dielectric fluid with a new dielectric fluid composition comprising:

at least one refined, bleached and deodorized Northern European winter rapeseed oil having a fatty acid distribution with an oleic acid content of about 57%, and at least one of an antioxidant and a pour point depressant;

wherein the new dielectric fluid composition has a pour point of less than about −20° C. as measured by either of ASTM D97 or ASTM D5950, and wherein the new dielectric fluid composition is essentially free of GMO material.

31. The method of claim 30, wherein the composition has a pour point of less than about −25° C. as measured according to either of ASTM D97 or ASTM D5950.

32. A method, comprising:

providing an electrical device comprising a conductor insulated by a paper insulating material; and extending the service life of the paper insulating material in the electrical distribution device by employing in the device a dielectric fluid composition comprising:

at least one refined, bleached and deodorized Northern European winter rapeseed oil having a fatty acid distribution with an oleic acid content of about 57%, and at least one of an antioxidant and a pour point depressant, wherein the dielectric fluid composition has a pour point of less than about −20° C. as measured by either of ASTM D97 or ASTM D5950, and wherein the dielectric fluid composition is essentially free of GMO material.

33. The method of claim 32, wherein the composition has a pour point of less than about −25° C. as measured according to either of ASTM D97 or ASTM D5950.

34. The method of claim 32, wherein the antioxidant compound comprises butylated hydroxyanisole (BHA), butylated hydroxytoluene (BHT), tertiary butylhydroxyquinone (TBHQ), tetrahydroxybutrophenone (THBP), ascorbyl palmitate, propyl gallate, alpha-, beta- or delta-tocopherol and combinations thereof.

35. The electrical device of claim 1, wherein the Northern European winter rapeseed oil has a fatty acid distribution with an oleic acid content of about 56% to about 58%.

36. The electrical device of claim 1, wherein the Northern European winter rapeseed oil has a fatty acid distribution with an oleic acid content of about 56% to about 58%.

37. The electrical device of claim 1, wherein the Northern European winter rapeseed oil has a fatty acid distribution with an oleic acid content of about 56% to about 58%, a linoleic acid content of about 19% to about 20%, and a linolenic acid content of about 9% to about 11%.

* * * * *